United States Patent [19]

Carroll

[11] 3,962,841

[45]*June 15, 1976

[54] INSULATED DECKING STRUCTURE AND METHOD

[75] Inventor: Frank E. Carroll, Barrington, Ill.

[73] Assignee: Decks, Incorporated, Rolling Meadows, Ill.

[ * ] Notice: The portion of the term of this patent subsequent to June 29, 1993, has been disclaimed.

[22] Filed: Jan. 30, 1975

[21] Appl. No.: 545,303

Related U.S. Application Data

[63] Continuation-in-part of Ser. No. 457,996, April 4, 1974.

[52] U.S. Cl. ..... 52/309; 52/354; 52/434; 428/304; 428/315; 428/321; 428/446

[51] Int. Cl.[2] ..... E04C 1/00

[58] Field of Search ..... 161/160; 52/738, 720, 52/729, 739, 734, 333, 338, 696, 339, 340, 689, 300, 434, 435; 156/71; 428/304, 306, 448, 308, 310, 313, 320, 315, 321, 333, 338, 339, 340

[56] References Cited

UNITED STATES PATENTS

| | | | |
|---|---|---|---|
| 426,558 | 4/1890 | Dithridge | 52/720 |
| 431,203 | 7/1896 | Dithridge | 52/738 |
| 1,360,720 | 11/1920 | Brown et al. | 52/729 |
| 3,148,752 | 9/1964 | Lesage | 52/729 |
| 3,162,280 | 12/1964 | Hinze | 52/731 |
| 3,211,597 | 10/1963 | Sheahan | 156/71 |
| 3,677,878 | 7/1972 | Carlson | 156/71 |
| 3,726,754 | 4/1973 | Coglianese et al. | 156/71 |
| 3,736,614 | 10/1973 | Hyde et al. | 156/71 |

*Primary Examiner*—William J. Van Balen
*Assistant Examiner*—Stanley S. Silverman
*Attorney, Agent, or Firm*—Thomas W. Speckman

[57] ABSTRACT

An insulated decking structure and method using a sheet metal structural shape as a purlin or sub-purlin which is symmetrical about a vertical bisecting plane and having a central vertical web, two legs projecting downwardly from the bottom of said web at an angle of about 45° to 75° to the horizontal, each leg having a substantially horizontal flange projecting outwardly at its lower extremity, and a stiffening member at the upper edge of the web. Poured concrete insulated deck structures utilize a series of the sheet metal structural shapes with gypsum formboard resting on the horizontal flanges and extending between adjacent structural shapes, rigid synthetic polymer foam having an underside adjacent the upper side of the gypsum form-board and having spaces vertically therethrough having an area of more than about 5 percent of the area of the upperside of the formboard, and poured concrete adjacent the upper side of the foam and through the above defined spaces and around the stiffener to prevent uplift. A precast insulated deck structure utilizing the sheet metal structural shape with the insulating slab resting on the horizontal flanges and extending between adjacent structural shapes with grouting between said precast slabs and around said stiffener to prevent uplift.

15 Claims, 6 Drawing Figures

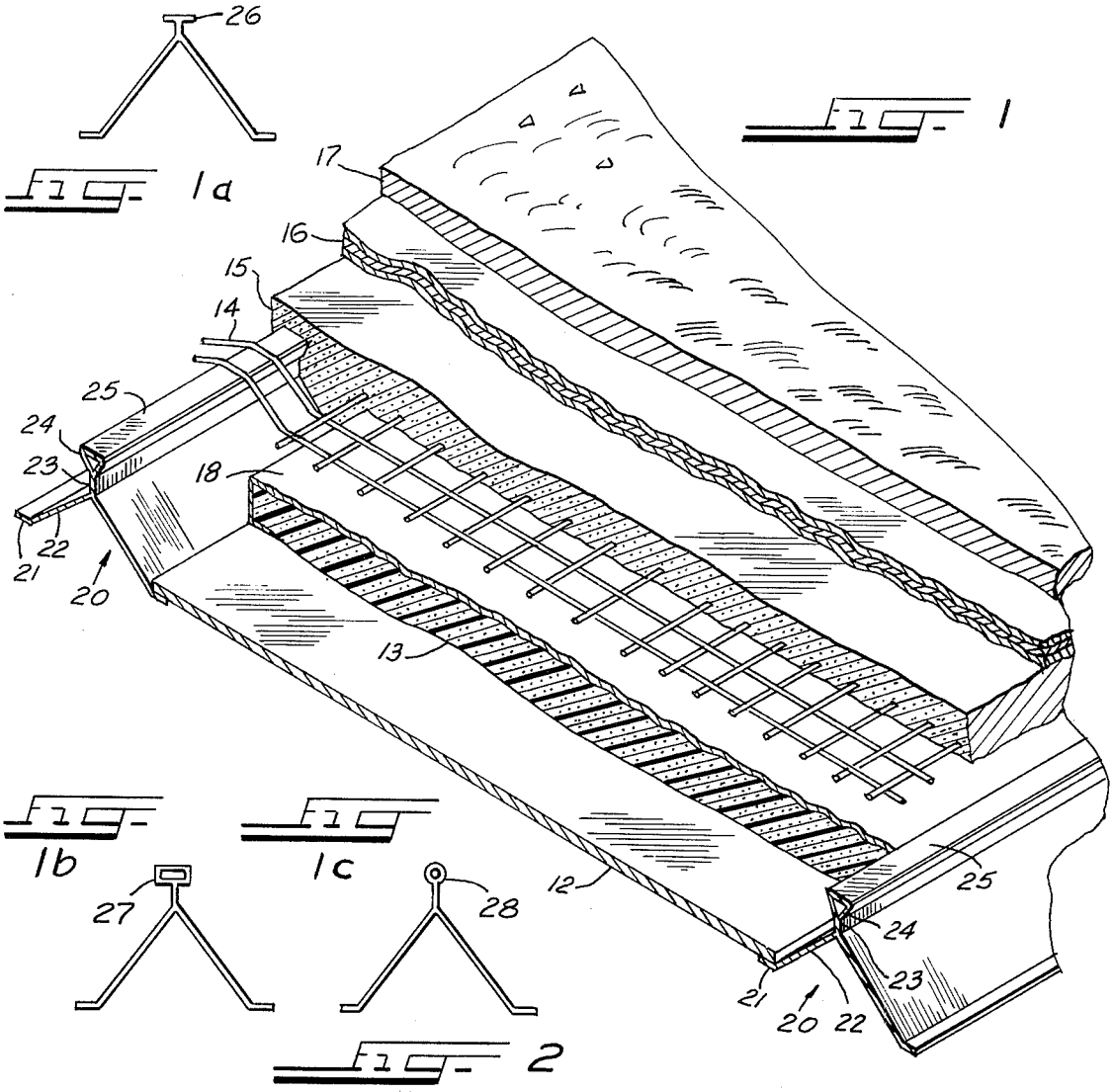
26
Fig. 1a
Fig. 1
17
16
15
14
25
24
23
18
22
21
20
13
12
Fig. 1b
Fig. 1c
27
28
Fig. 2
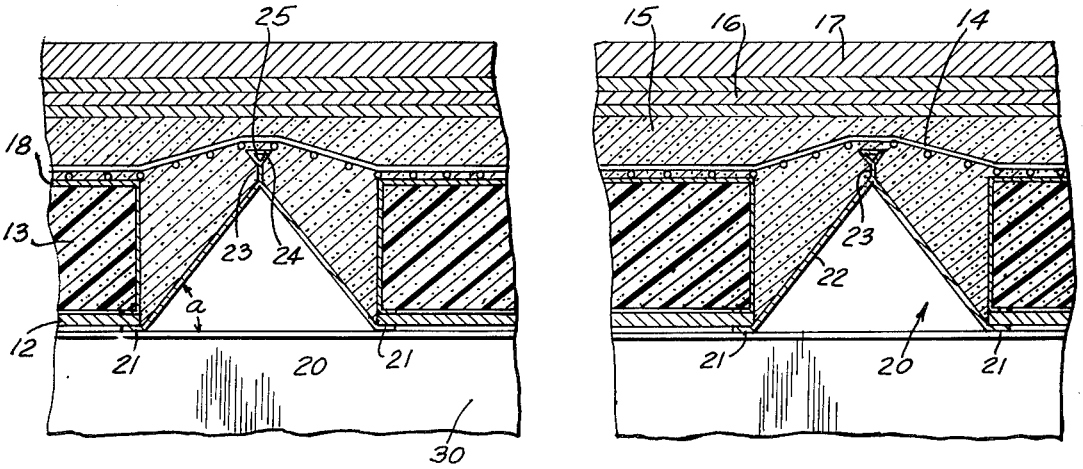
25
18
13
23
24
a
12
21
20
21
30
15
16
17
14
23
22
21
20
21

INSULATED DECKING STRUCTURE AND METHOD

CROSS-REFERENCE TO RELATED APPLICATION

This application is a continuation-in-part of my pending application, Ser. No. 457,996, filed Apr. 4, 1974.

This invention relates to an insulated roof structure and method utilizing a sheet metal structural shape and providing superior fire protection and insulation properties. The roof structure of this invention is generally a poured gypsum or other poured concrete-like roof deck system wherein gypsum formboard is laid on a novel sheet metal structural shape sub-purlin or purlin structure. A foamed synthetic organic polymer board having holes vertically therethrough to permit moisture from the poured concrete to penetrate to the gypsum formboard for drying is placed adjacent and above the formboard. Reinforcing wire mesh, the poured concrete and a standard weatherproof barrier is then applied resulting in a unitized structure affording high strength, high insulation properties, fire resistance and design versatility.

Previously, most efficient integral insulation properties were most frequently obtained when conventional metal roof decks were installed followed by foam insulation covered with a weatherproof barrier or traffic layer, such as bitumen and roofing felt. However, such structures do contribute to the spread of a fire in a building under such a metal roof deck. U.S. Pat. No. 3,466,222 is illustrative of recent attempts to overcome such disadvantages. However, the structure shown in the U.S. Pat. No. 3,466,222 patent only slows down fire damage and does not eliminate it, the roof being susceptible to total destruction by the foam disintegrating and permitting the weatherproofing materials to burn even when utilizing an expensive metal deck roof system.

Poured gypsum roof deck systems have long been recognized as economical and furnishing a fire-proof roof structure. In the conventional poured gypsum roof deck system, gypsum formboard is laid over the steel sub-purlin assembly, a layer of interwoven steel reinforcing mesh placed over the gypsum form-board and poured in place slurry of gypsum concrete applied to conventional two inches thick. Such roof systems are known to provide satisfactory two hour fire ratings and low flame spread ratings. However, attempts to provide insulation to such roof deck systems has not proved satisfactory. One attempt has been to use perlite aggregate in the gypsum concrete, however, this does not give desired insulation properties. Another attempt has been to provide insulation beneath the roof deck structure, however, such insulation either adds to combustion in the interior of the building or is expensive if incombustible mineral fiber is used. Other attempts to provide both satisfactory insulation and fireproof properties have been to utilize formboard which is both fireproof and has insulating properties. Such formboards are those manufactured from mineral fiber materials and fiber glass materials, but these are both expensive and do not provide the desired insulation properties while being more difficult to use in field erection.

It is an object of this invention to overcome the above disadvantages.

It is a further object of this invention to provide an economical, insulating and fireproof poured gypsum roof deck system.

It is still another object of this invention to provide a poured gypsum roof deck system having integral thermal insulation properties which provide satisfactory two-hour fire ratings.

It is another object of this invention to provide an economical precast slab deck system.

These and other objects, advantages and features of this invention will be apparent from the description and by reference to the drawings wherein preferred embodiments are shown as:

FIG. 1 is a perspective cutaway view of an insulated roofing structure of one preferred embodiment of this inventon; FIGS. 1*a* – 1*c* show different configurations of the sheet metal structural shapes which may be used in this invention;

FIG. 2 is a sectional view of an insulated roofing structure of one embodiment of this invention.

Figure 3:
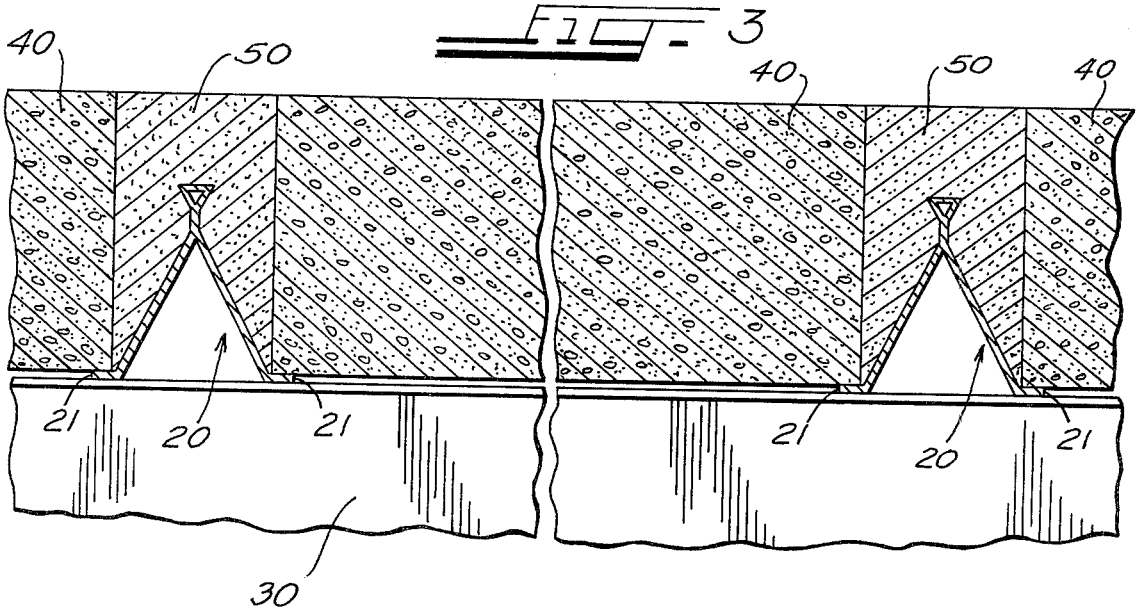
FIG. 3 is a sectional view of an embodiment of this invention using precast boards.

The sheet metal structural shape used in this invention provides excellent structural characteristics while reducing weight and providing a structural shape which can be readily fabricated from sheet metal. It is highly desirable to fabricate structural shapes from sheet metal to minimize energy requirements in production and to conserve steel. Prior attempts to utilize sheet metal shapes in poured roof construction have not been satisfactory. Some prior attempts have utilized sheet metal ⊥ shapes as substitutes for bulb tees in roof deck construction. These sheet metal ⊥ shapes while providing sufficient strength in the composite assembled poured roof do not have satisfactory strength characteristics themselves and in the erection, bend over or roll when walked upon by the erectors. This results in a very dangerous situation for the workers. The sheet metal structural shapes of this invention provide desirable strength characteristics themselves and sufficient strength characteristics to be walked upon during erection without dangerous bending or rolling.

Referring to FIGS. 1 and 2, the sheet metal shape used in this invention is symmetrical about a vertical bisecting plane. The shape has a central vertical web 23 from which two legs 22 project downwardly for equal lengths at an angle, shown in FIG. 2 as *a*, of about 45° to about 75° to the horizontal. Each leg has a substantially horizontal flange 21 projecting outwardly at its lower extremity. The upper edge of web 23 has a structurally stiffening member such as a flange or a triangle. I prefer an inverted isosceles triangle having its vertex at the top of the web and the opposite side substantially horizontal.

Horizontal flange 21 may vary in length suitable to hold the desired formboard or other decking material. I have found from about ½ to about 1 inch to be suitable. The vertical depth of the legs 22 may be varied to suit the strength requirements of the desired span. I have found about 1-⅛ to about 4 inches satisfactory when using the shapes as sub-purlins and about 4 to about 10 inches satisfactory when using the shapes for purlins. The angle of legs 22 with the horizontal are suitably about 45° to about 75°. When used as purlins, this angle is preferably about 60° to about 75°. When used as sub-purlins, this angle is preferably about 50° to about 60°, about 55° being especially preferred. Web 23 is important to supply vertical strength and also to prevent bending or rolling of the shapes when they are walked upon by erection workers. I have found that regardless of the depth of legs 22, a suitable dimension for web 23 is about ⅜ to ⅝ inch, about ½ inch being preferred. As pointed out above various forms may be utilized as stiffeners on the upper edge of web 23. A preferred shape of stiffener is an inverted isosceles triangle as shown in FIG. 1 having sides 24 and base 25. It is preferred that sides 24 be about 3/16 to about ½ inch, preferably about ¼ inch when the shape is used as a sub-purlin and about ⅜ to about ¾ inch, preferably about ½ inch when the shape is used as a purlin. It is preferred base 25 be about 5/16 to about ½ inch, preferably about ⅜ inch when the shape is used as a sub-purlin and about ½ to about 1-¼ inch, preferably about ¾ inch when the shape is used as a purlin. The stiffener at the upper end of web 23 may also be in the form of a horizontal flange shown as 26 in FIG. 1*a*, a box shape as shown as 27 in FIG. 1*b*, or a circular shape as 28 in FIG. 1*c*. It is desired that the shape permit the poured concrete to flow both under and over the stiffener to prevent vertical displacement or uplift.

The sheet metal sections used in this invention may be fabricated by well known roll forming techniques from sheet steel from about 20 gauge to about 14 gauge.

Engineering data for exemplary sheet metal thicknesses and leg depths are as follows given for the sheet metal shape itself prior to incorporation into a composite structure which would greatly increase the strength characteristics.

Sheet metal shape having suitable gauge and depth for use as sub-purlin:

18 gauge
75° leg angle to horizontal
0.974 pounds per foot
1.25 inch vertical depth of diagonal legs
0.1411 Moment of inertia
0.175 Section Modulus
5.68 foot span at steel working stress of 48,000 psi Sheet metal shape having suitable gauge and depth for use as purlin:

16 gauge
75° leg angle to horizontal
4.767 pounds per foot
9.0 inch vertical depth of diagonal legs
14.23 Moment of inertial
3.01 Section Modulus
19.8 foot span at steel working stress of 48,000 psi These sheet metal shapes are particularly advantageously utilized in poured and precast roof deck construction. As shown in FIG. 1, sheet metal shape 20 holds formboard 12 on flanges 21. Sheet insulating material 16 is placed on top of formboard 12 and is approximately the same width as formboard 12 providing space between the sides of the insulating material and legs 22 for the poured concrete to flow into. After the concrete is poured it is seen that the concrete stiffens the sheet metal shape 20 against spreading. Further, the fact that the concrete is adjacent the legs 22 of the sheet metal shape increases the fire resitance of the sheet metal shape. The insulating material 13 is advantageously of a thickness such that its top surface is about even with the bottom of web 23, or at least within the depth of web 23.

The Λ configuration on the inside of the structure resulting from the use of sheet metal shapes of this invention provides space for wiring, plumbing, lighting and the like and when so utilized the opening may be covered with any suitable opaque or translucent covering. Roof level solar energizers will employ auxiliary componets which, too, may be housed in the Λ configuration.

The Λ configuration on the inside of the structure also serves as noise baffles to reduce noise levels.

Referring to FIG. 1, sub-purlins 22 may be supported by any suitable structural members such as open web joists and I beams, such as shown in FIG. 2 as "30", spaced at proper intervals making a suitable roof support member system. Any roof support member system suitable for support of the poured roof is satisfactory. Gypsum formboard, shown as 12, having a desired thickness of perforated synthetic organic polymer foam shown as 13 in contact with the upper side of the gypsum formboard are supported by the sub-purlins 22. The formboard and foam may be utilized in prepared panels with the formboard and foam laminated or may be built-up on the job site. The synthetic organic polymer foam has spaces vertically providing communication between the volume above the polymer foam to the upper surface of the gypsum formboard. The spaces through the foam may be perforations of any shape providing sufficient drying area. Perforated polymer foam boards are available commercially from W. R. Grace & Co. Such boards have previously been used for insulation over metal roof decks to enable the drying of light weight concrete poured over the foam board.

One preferred system as more fully described in my pending U.S. Pat. application Ser. No. 410,874, entitled "Insulated Roofing Structure and Method" has the holes through the polymer foam in the shape of truncated cones so that the area of the openings adjacent the gypsum formboard is greater than the area of the openings at the top surface of the polymer foam thereby providing a unitized structure between the poured gypsum and the formboard.

It is desired that the spaces through the polymer foam have an area of more than about 5 percent of the area of the upper side of the gypsum formboard. It is preferred that the spaces through the polymer foam adjacent the gypsum formboard be about 5 to 20 percent of the surface area of the upper side of the gypsum formboard, especially preferred being about 5 to 10 percent of the surface area.

It is especially desired when using the sheet metal shapes as sub-purlins or purlins that the edges of the polymer foam near the sheet metal shapes also have horizontal holes in communication with the inner vertical holes to provide additional drying capability for the volume of concrete surrounding the sides of the foam.

Any gypsum formboard providing a two hour fire rating when used with poured gypsum slabs is suitable. The lease expensive of the gypsum formboards, the rigid one-half inch thick gypsum formboard is suitable for use in the roof structure of this invention, however, various surfaced gypsum formboards having suitable ceiling surfaces may be utilized as long as the incombustibility and flame spread ratings are satisfactory.

The synthetic organic polymer foam may be any substantially rigid organic polymer foam having good insulating properties and preferably a high temperature at which thermal decomposition occurs. Suitable foams include polystyrene, styrene-maleic anhydride, phenolic, such as phenol formaldehyde, polyurethane, vinyl, such as polyvinyl chloride and copolymers of polyvinyl chloride and polyvinyl acetate, epoxy, polyethylene, urea formaldehyde, acrylic, polisocyanurate and the like. Preferred foams are selected from the group consisting of polystyrene and polyurethane. Particularly suitable foams are closed cell foams which provide high insulating properties and low internal permeability to moisture. Such organic polymer foams are substantially rigid bodies of foam and are well known for their low density and outstanding thermal insulating properties. Previously, use of organic polymer foams in roof structures has been limited due to the need for care and special attention in installation if they are used alone and due to their decomposition at higher temperatures permitting structural damage. In accordance with this invention these disadvantages are overcome and polystyrene may be advantageously utilized.

The organic polymeric foam and the gypsum formboard may be preassembled by fastening the foam to the formboard by any suitable fastening means. Suitable fastening means include synthetic and natural adhesives, wire staples, metal clips and the like. Suitable synthetic adhesives include epoxy, polyurethane, polyamide and polyvinylacetate and its copolymers. Adhesives and wire staples are preferred. The polymer foam and gypsum formboard may also be readily assembled at the construction site by first laying the formboard in place and placing the foam on top of it in a fashion to hold the foam the desired distance from the purlins. The foam may be stapled to the formboard.

Following installation of the gypsum formboard - polymer foam, standard reinforcing wire mesh used in poured gypsum deck assemblies, shown as 14 is applied and gypsum concrete poured to a suitable thickness of about 1-½ to about 3 inches over the surface of the polymer foam, about 2 inches being preferred. The poured gypsum concrete flows through larger openings, if provided, in the polymer foam and adheres to the upper surface of the gypsum board 12. This structure provides an integral roofing structure having desired fireproof and internal insulation properties.

The gypsum concrete utilized may be preferably standard gypsum concrete. However, modified concretes containing various fillers, such as perlite, aggregate for thermal insulation and lighter weight are suitable, or exploded mica in portland cement is suitable, but not necessary in the roof structure of this invention. The gypsum concrete is especially desirable for use in roof structures not only because it is incombustible but also because the gypsum sets within a few minutes to form a slab that is hard enough to walk upon thereby permitting, in many cases, a waterproof wearing surface to be laid the same day the slab is poured. When any type of portland cement is used, the setting time is much slower and to prevent moisture from sagging the formboard, I have found it desirable to place a moisture permeable sheet between the cement and the top surface of the formboard. I have found that moisture permeable paper, such as gypsum board paper, preferably placed on top of the foam, is satisfactory.

In FIG. 1 a built-up roofing membrane comprising alternate layers of roofing felt and hot asphalt is shown as 16 with a waterproof wearing surface 17 of tar and gravel. Any suitable waterproof wearing surface for flat type roofs is suitable for the roof structure of this invention, or the gypsum concrete may be waterproofed with plastic membrane, such as on dome type roof structures.

The drying of the concrete continues by removal of moisture from the concrete for several weeks after pouring. I have found that in using the roof structure of this invention the drying time of the concrete is not greatly increased. This results from the concrete being in communication through spaces between or holes in the polymer foam with the gypsum formboard which is porous to water. The drying of the concrete after a built-up type roofing membrane is applied to its exterior continues by the moisture escaping through the formboard.

The roof structure of this invention provides properties which are presently being called for by newer building regulations. The first such property is fire ratings which, following suitable ASTM testing, result in two hour fire ratings for the roof structure. The second important property is thermal insulation combined with the satisfactory fire rating. Present energy conservation considerations result in a "U" value of 0.10 and less being desirable. Calculations show that roof structures of this invention utilizing the sheet metal shape as a purlin and using polystyrene and gypsum concrete result in "U" values of 0.06 and less. When the sheet metal shape is utilized as a sub-purlin with ½ inch gypsum formboard, 1-½ inch polystyrene foam board and 2 inch gypsum concrete the U value is 0.10. Thus, an inexpensive deck is provided having both a two hour fire rating for Class 1 fire rated construction and insulation properties resulting in U values of 0.10 and less. Further, a range of desired insulating properties may be achieved by varying the thickness of the synthetic polymer foam.

Any suitable ceiling structure may be installed beneath the roof structure of this invention as long as suitable ventilation is furnished. However, in contrast to prior roof structures, it is not necessary that the ceiling provide the insulation or fireproofing qualities. The roof structure of this invention provides high insulation and fireproof properties without any structure beneath it and may be left exposed. Further, when the sheet metal shape is used directly as a purlin, about one foot of interior occupancy space is gained over conventional construction using exposed joists which must also be fireproofed.

The sheet metal shapes may also be utilized in roof deck construction utilizing precast slabs and precast fireproof and insulating slabs such as fibrous materials bonded with hydraulic cement binders as shown in FIG. 3. The slabs 40 are laid on flanges 21 and the space between the slabs and sheet metal shape 20 is covered from the top with grout 50. Any precast slab affording desired fireproofing and insulating properties is suitable for use in the deck of this invention.

While my invention has been described with respect to a roof deck system, it is also suitable and intended for any deck system such as flooring - ceiling in multistory construction.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A poured concrete insulated deck structure comprising:

a series of parallel sheet metal structural shapes which are symmetrical about a vertical bisecting plane having a central vertical web, two legs projecting downwardly from the bottom of said web at an angle of about 45° to about 75° to the horizontal, each leg having a substantially horizontal flange projecting outwardly at its lower extremity, and a stiffening member at the upper edge of said web;

gypsum formboard resting on said horizontal flanges and extending between adjacent structural shapes;

rigid synthetic polymer foam having an underside adjacent the upper side of said gypsum form-board and having spaces vertically communicating from the upper side of said formboard to the upper side of said foam, said spaces having an area of more than about 5 percent of the area of the upper side of said formboard; and poured concrete adjacent the upper side of said foam and around said stiffener to prevent uplift and extending through said spaces contacting the upper side of said gypsum formboard, said concrete completing drying by escape of moisture through said gypsum formboard.

2. The deck structure of claim 1 wherein the area of said spaces is about 5 to about 20 percent.

3. The deck structure of claim 1 wherein said foam is selected from the group consisting of polystyrene, styrene-maleic anhydride, phenolic, such as phenol formaldehyde, polyurethane, vinyl, such as polyvinyl chloride and copolymers of polyvinyl chloride and polyvinyl acetate, epoxy, polyethylene, urea formaldehyde, acrylic, and polyisocyanurate.

4. The deck structure of claim 3 wherein said foam is selected from the group consisting of polystyrene and polyurethane.

5. The deck structure of claim 1 wherein said structural shapes are purlins.

6. The deck structure of claim 1 wherein said structural shapes are sub-purlins resting upon a structural member.

7. The deck structure of claim 1 wherein said synthetic polymer foam additionally has horizontal holes in communication with said vertical spaces along the sides of said foam to provide additional drying capability for the volume of concrete adjacent said sheet metal shape.

8. The deck structure of claim 1 wherein said concrete is gypsum concrete and said polymer foam is polystyrene.

9. The deck structure of claim 1 wherein said web is about ⅜ to about ⅝ inch in length.

10. The deck structure of claim 1 wherein said angle is about 60° to about 75° for use as purlins and about 50° to aout 60° for use as sub-purlins.

11. The deck structure of claim 1 wherein said legs have a vertical depth of about 1-⅛ to about 4 inches for use as sub-purlins and about 4 to about 10 inches for use in purlins.

12. The deck structure of claim 1 wherein said horizontal flange is about ½ to about 1 inch.

13. The deck structure of claim 1 wherein said stiffening member at the upper edge of said web is an inverted isosceles triangle.

14. The deck structure of claim 13 wherein said triangle has sides of about 3/16 to about ½ inch when said shape is used as sub-purlin and about ⅜ to about ¾ inch when said shape is used as a purlin and has a base about 5/16 to about ½ inch when said shape is used as a sub-purlin and about ½ to about 1-¼ inch when said shape is used as a purlin.

15. An insulated deck structure comprising:

a series of parallel sheet metal structural shapes which are symmetrical about a vertical bisecting plane having a central vertical web, two legs projecting downwardly from the bottom of said web at an angle of about 45° to about 75° to the horizontal, each leg having a substantially horizontal flange projecting outwardly at its lower extremity, and a stiffening member at the upper edge of said web;

precast slab resting on said horizontal flanges and extending between adjacent structural shapes; and grouting between said precast slabs and around said stiffener to prevent uplift.

* * * * *